United States Patent [19]

St. Louis

[11] Patent Number: 4,628,661

[45] Date of Patent: Dec. 16, 1986

[54] SCORED METAL APPLIANCE FRAME

[75] Inventor: Robert M. St. Louis, St. Leonard, Canada

[73] Assignee: Camco Inc., Weston, Canada

[21] Appl. No.: 729,041

[22] Filed: Apr. 30, 1985

[30] Foreign Application Priority Data

Sep. 6, 1984 [CA] Canada ..... 462513

[51] Int. Cl.[4] ..... E04C 2/38

[52] U.S. Cl. ..... 52/658; 52/105; 72/379

[58] Field of Search ..... 52/98, 105, DIG. 6, 52/658; 72/379

[56] References Cited

U.S. PATENT DOCUMENTS 2,560,786 7/1951 Wright et al. ..... 72/379 X
4,410,294 10/1983 Gilb et al. ..... 52/105 X

FOREIGN PATENT DOCUMENTS 1336598 11/1973 United Kingdom ..... 52/105

*Primary Examiner*—Carl D. Friedman
*Assistant Examiner*—Naoko N. Slack

[57] ABSTRACT

An appliance frame having a score line formed by pressing metal to form a plurality of dimples each having a substantially straight severed edge extending out of the plain of the metal and arranged in a substantially straight line to form the score line, thereby to weaken the metal sufficiently that it may be manually bent to form a substantially right-angle bend at the score line.

14 Claims, 6 Drawing Figures

SCORED METAL APPLIANCE FRAME

FIELD OF THE INVENTION

The present invention relates to the forming of a score line in a metal sheet member so that the member may be subsequently bent manually along the score line. More particularly, the present invention relates to an appliance frame having a preformed score line where the sheet metal has been weakened to permit manual bending along a pre-defined score line.

BACKGROUND OF THE INVENTION

In the manufacture of appliances, various elements and skins of the appliance itself, particularly a major appliance, are hung from a frame which is generally formed by a piece of sheet metal bent normally into a substantially U-shaped configuration. One arm of the U forms the front, the second arm of the U, a shorter arm forms the rear and a bridging member between the two arms, forms the base or bottom of the unit.

With such a conventional frame, the current practice requires a special bending tool or jig to form the frame into the U-shaped configuration somewhere along the assembly line so that the U-shaped frame then may be utilized to build up the appliance. Obviously the requirement for a bending press to bend the frame into the necessary configuration is relatively costly and requires means to transfer the bent or formed frame from the bending means to the assembly line and further handling.

BRIEF DESCRIPTION OF THE PRESENT INVENTION

It is an object of the present invention to provide a score line in a sheet metal member to permit bending of the sheet metal member manually to form an accurately positioned corner.

Broadly, the present invention relates to a score line formed in a sheet metal member, said score line comprising a plurality of dimples pressed into the sheet metal member, each of the said dimples being formed with a substantially straight cut edge, forming and aligned in said score line, said cut edges projecting out of the plane of the sheet metal, said score line weakening said sheet metal so that said sheet metal may be bent manually along said score line at the desired angle to provide an accurately positioned corner and preferably to a right angle with said cut edge adjacent a face of the portion of said sheet metal on the opposite side of said score line from said dimple.

Preferably the score line will be applied to sheet metal formed to provide a frame for the appliance frame wherein a pair of score lines will be positioned in spaced relation so that the frame member may be formed into substantially U-shaped configuration by bending along with two spaced score lines.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
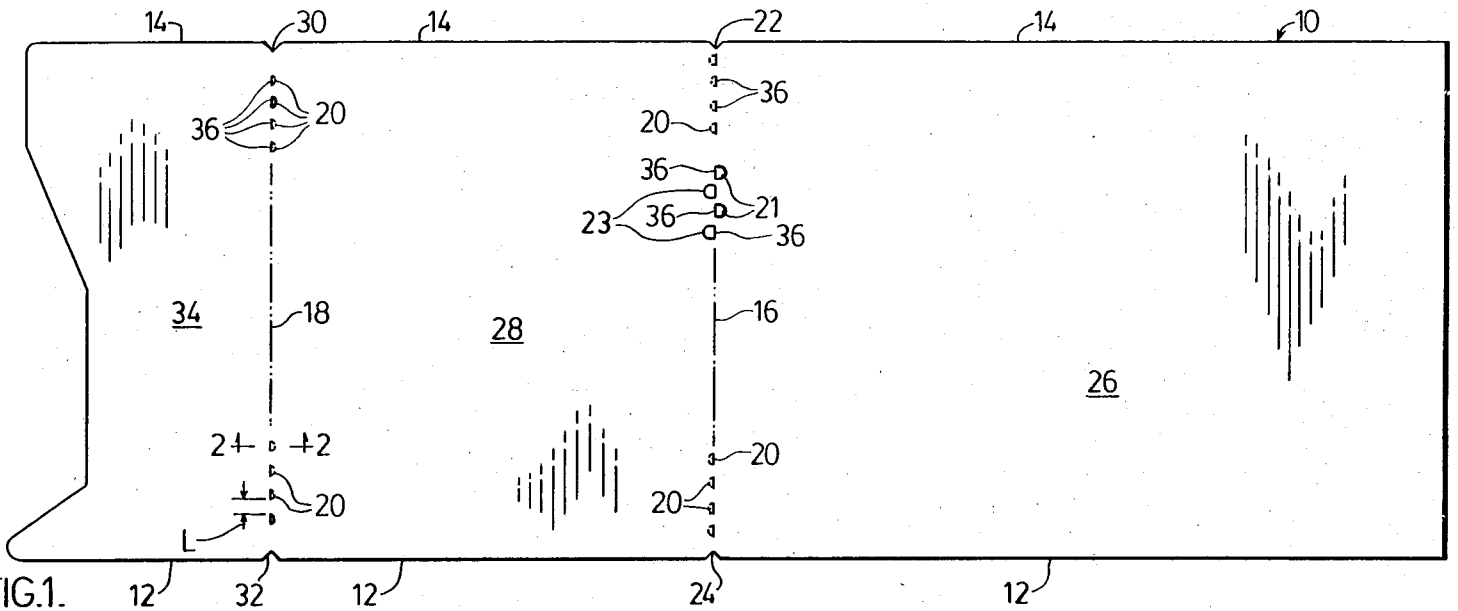
FIG. 1 is a plan view of a frame member of an appliance scored in accordance with the present invention.
Figure 2:
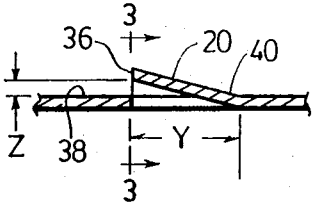
FIG. 2 is a section along the line 2—2 of FIG. 1 showing a dimple pressed out of the sheet metal.

As shown in FIG. 1, the frame member 10 incorporating the present invention is composed of a unitary sheet of metal and has side flanges 12 and 14 extending substantially along the full length of the side edges of the sheet metal 10.

In the illustrated arrangement a pair of score lines 16 and 18 are provided. Each of these score lines is formed by a plurality of spaced dimples 20 pressed into the sheet metal 10 as will be described in more detail hereinbelow.

In the illustrated arrangement, aligned with the score line 16, i.e. at opposite ends thereof, are nicks generally indicated at 22 and 24 which permit the panel 26 on one side of the score line 16 to be folded into a position at an angle to the panel 28 on the opposite side of the score line 16. Similarly nicks 30 and 32 through the flanges 12 and 14 and partly into the sheet 10 are formed at axial ends of the score line 18 to permit the panel 34 to be folded into the position at an angle to the panel 28 without the flanges 12 and 14 interfering with the folding action. The nicks 22, 24, 30 and 32 will preferably be substantially right angular to permit folding at an angle of 90°. Obviously the nicks will be symmetrical on opposite sides of their respective fold lines.

As shown in FIG. 1, each dimple is substantially half-moon shaped and is defined on one side by a cut edge 36 extending as a substantially straight line aligned with its respective fold line 16 or 18 and by a curved line interconnecting the ends of the cut edge defining the remainder of the half-moon shape bent out of the plane of the sheet metal 10.

It will be noted that the edge 36 at its maximum projection from the surface 38 of the sheet metal 10 as indicated by the distance Z is spaced from the plain of the sheet 10 by about ½ to 1 millimeter. The distance between the edge 36 and a remotest portion of the curved line at the opposite end of the dimple 20 as indicated at 40 is a distance Y which may be any convenient dimension but normally will be in the range of about 5 to 10 millimeters.

Figure 3:
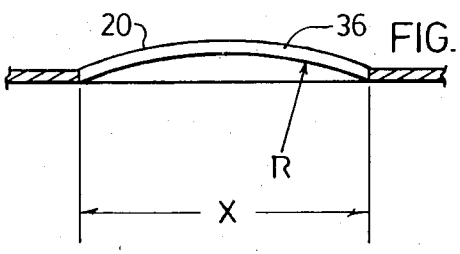
FIG. 3 is a section along the line 3—3 of FIG. 2, showing one form of dimple cross section.
Figure 4:
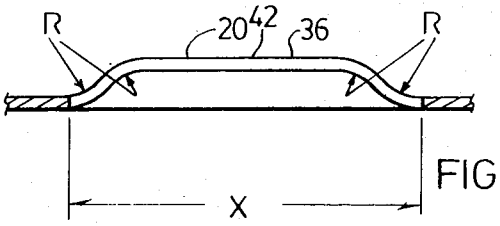
FIG. 4 is a view similar to FIG. 3, showing another form of dimple cross section.

The length of the cut edge 36 as shown by the distance X in FIGS. 3 and 4 will normally be in a range of 10 to 50 millimeters, preferably about 25 millimeters. The distance or spacing between the adjacent of the dimples as measured between the adjacent edges of the cut edges 36 of adjacent dimples 20 is indicated by the distance L in FIG. 1. This distance L will normally be 5 to 50 millimeters and preferably equal to ½ the distance X so that ⅔ of the material forming the score line 18 is actually cut or severed. Obviously the dimensions of the dimple 20 may vary to some degree depending on the caliper or thickness of the sheet metal being formed.

The dimple 20 may be in any convenient shape. Two cross sections are shown, as examples in FIGS. 3 and 4. In FIG. 3, the dimple 20 at the cut edge 36 is simply a segment of a circle whereas in FIG. 4 the material is deformed along a pair of oppositely curved short radius fillets of radius R at each end of the edge 36 interconnected by a substantially straight section 42 of the cut edge 36. The radius R will normally have a length of about ½ dimension Z.

Figure 6:
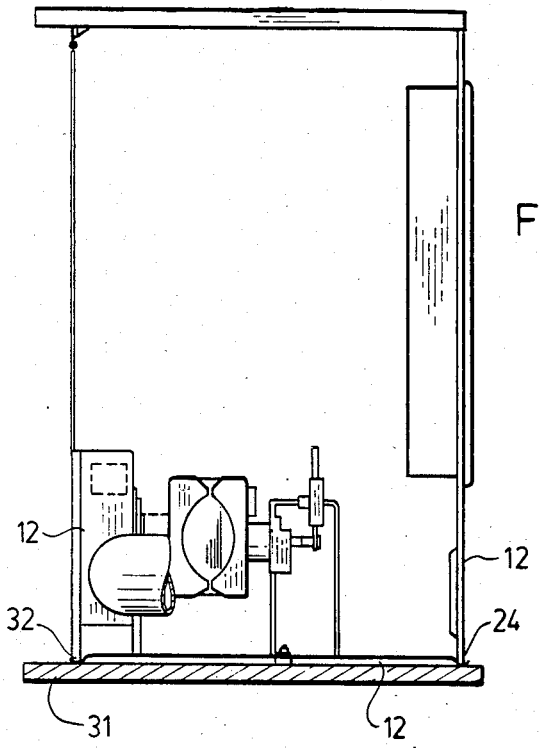
FIG. 6 shows as a schematic illustration of the frame member of FIG. 5, located within a partially formed and assembled appliance.
Figure 5:
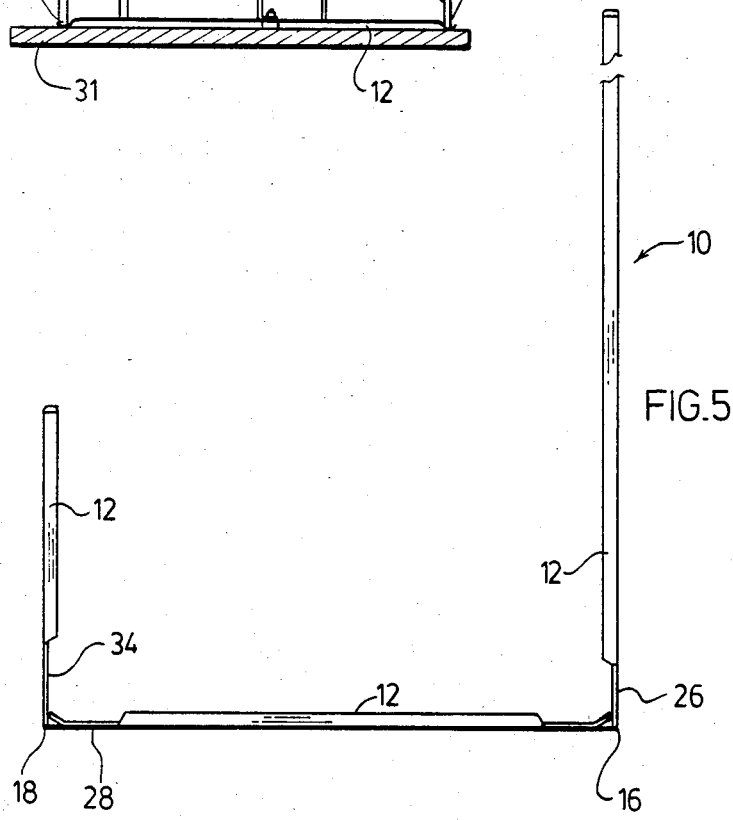
FIG. 5 shows the frame member of FIG. 1 folded into substantially U-shaped configuration.

The frame member 10 may be manually bent on the fold lines 16 and 18 as shown in FIGS. 5 and 6. In FIG. 5, flanges 12 have been broken away in the corners to show that the edges 36 of the dimples 20 approach the inner face of panel 26 or 34 when these panels are folded into position substantially perpendicular to the panel 28. As shown in FIG. 6, the nicks or cutouts 22, 24, 30 and 32 are substantially closed when the panels 26 and 34 are folded in substantially perpendicular to the panel 28. In FIG. 6 the appliance is shown mounted on its crating base 31.

It will be apparent that the weakening of the sheet metal forming the panel frame 10 on the fold lines 16 and 18 must be sufficient to permit manual folding and ensure accurate positioning of the folding along fold lines or score lines 16 and 18. It will further be noted that in the arrangement illustrated the edges 36 are in a straight line relationship to define fold lines or score lines 16 and 18 and that each of the dimples 20 is on one side of its respective score lines. It will be apparent that the dimples 20 can be arranged on opposite sides of the score line for example in staggered relationship provided the cut edges 36 are still in straight line relationship, i.e. the dimple arrangement illustrated by dimples 21 and 23 along line 16 in FIG. 1 (dimples 21 and 23 have been shown slightly enlarged). The edge 36 of dimples 21 and 23 are shown axially aligned but they could be arranged so that the edges of dimples 21 and 23 are parallel but are spaced apart slightly, e.g., formed along opposite edges of a wide straight line so that in the illustrated arrangement the edges 36 of the dimples 21 would be parallel to but spaced to the right of the edges 36 of dimples 23 by a distance of up to about ⅛ of an inch. The fold line 16 is formed between the edges 36 of the dimples 21 and 23. The spacing of edge 36 limits control of the fold line location but increases the fillet radius formed at the bend. It is generally preferred to use the arrangement substantially as shown for the dimples 20 in fold line 18.

It is also possible to force the dimples from opposite faces of the sheet metal 10 but this is not preferred.

While bending of the panels along the score lines at 90° has been illustrated it will be apparent that any desired angle may be formed. Obviously if a larger angle is desired the nicks 22, 24, 30 and 32 must be large enough to accomodate the bigger angle and the edges 36 may be forced against and indent the face of the adjacent panel if the dimples are formed toward the inside of the bend.

Having described the invention, modifications will be evident to those skill in the art without departing from the illustration of the invention as defined in the appended claims.

What I claim as new and desire to secure by Letters Patent of the United States is:

1. A frame work formed from a prescored substantially planer sheet of sheet metal, said frame work being adapted to be formed so that at least one panel thereof extends at an angle to an adjacent panel comprising a straight score line forming the line of demarcation between said panels, said straight score line being formed of a plurality of spaced dimples pressed from said sheet metal, each of said dimples having a straight severed edge pressed from the plane of said sheet metal, said severed edges on said dimples being parallel and extending substantially along said straight score line, the remainder of said sheet metal along said score line and adjacent said straight edges of said dimples being substantially in tact, the length of said severed edges and number of said dimples and the spacing therebetween being coordinated so that said sheet metal may be manually folded on said score line provide an accurately positioned fold.

2. A frame work as defined in claim 1 wherein said severed edges all project from one side of said sheet metal toward the inside of said bend formed when said sheet metal is manually bent on said fold line.

3. A frame work as defined in claim 2 wherein all of said dimples are on one side of said straight line and said severed edges are aligned on said straight line.

4. A frame work as defined in claim 3 wherein said severed edges of said dimples project between ½ and 1 millimeter from said inside face of said sheet metal.

5. A frame work as defined in claim 3 wherein said severed edge of each of said dimples extends for a length of between 5 and 50 millimeters along said fold line wherein the spacing between the adjacent severed edges of adjacent dimples is a distance of between 5 and 50 millimeters.

6. A frame work as defined in claim 5 wherein said spacing between the adjacent severed edges is about ½ of the length of said severed edges.

7. A frame work as defined in claim 6 wherein said severed edges of said dimples project between ½ and 1 millimeter from said inside face of said sheet metal.

8. A frame work as defined in claim 6 wherein said frame work comprises an appliance frame provided with side flanges substantially perpendicular to said score line, said flanges being nicked substantially at an angle of 90° at said score lines, the apex of the angle of said nicks being aligned with said score line and said nicks being symmetrically positioned on opposite sides of said score line.

9. A frame work as defined in claim 8 wherein two spaced substantially parallel of said straight score lines are formed in said sheet metal and wherein said frame work is formed to a substantially U-shaped configuration by manually bending along said two score lines thereby to provide an appliance frame.

10. A frame work as defined in claim 3 wherein said frame work comprises an appliance frame provided with side flanges substantially perpendicular to said score line, said flanges being nicked substantially at an angle of 90° at said score lines, the apex of the angle of said nicks being aligned with said score line and said nicks being symmetrically positioned on opposite sides of said score line.

11. A frame work as defined in claim 10 wherein two spaced substantially parallel of said straight score lines are formed in said sheet metal and wherein said frame work is formed to a substantially U-shaped configuration by manually bending along said two score lines thereby to provide an appliance frame.

12. A frame work as defined in claim 3 wherein two spaced substantially parallel of said straight score lines are formed in said sheet metal and wherein said frame work is formed to a substantially U-shaped configuration by manually bending along said two score lines thereby to provide an appliance frame.

13. A frame work as defined in claim 1 wherein said frame work comprises an appliance frame provided with side flanges substantially perpendicular to said score line, said flanges being nicked substantially at an angle of 90° at said score lines, the apex of the angle of said nicks being aligned with said score line and said nicks being symmetrically positioned on opposite sides of said score line.

14. A frame work as defined in claim 1 wherein two spaced substantially parallel of said straight score lines are formed in said sheet metal and wherein said frame work is formed to a substantially U-shaped configuration by manually bending along said two score lines thereby to provide an appliance frame.

* * * * *